US007581334B2

(12) United States Patent
Majima

(10) Patent No.: US 7,581,334 B2
(45) Date of Patent: Sep. 1, 2009

(54) DRYING APPARATUS

(75) Inventor: Shinji Majima, Shizuoka (JP)

(73) Assignee: Fujifilm Corporation, Tokyo (JP)

( * ) Notice: Subject to any disclaimer, the term of this patent is extended or adjusted under 35 U.S.C. 154(b) by 172 days.

(21) Appl. No.: 10/920,186

(22) Filed: Aug. 18, 2004

(65) Prior Publication Data

US 2005/0050755 A1 Mar. 10, 2005

(30) Foreign Application Priority Data

Sep. 4, 2003 (JP) ..... 2003-312433

(51) Int. Cl.
*F26B 21/06* (2006.01)

(52) U.S. Cl. ..... 34/212; 34/215; 34/216; 34/219; 34/551; 34/72; 34/86

(58) Field of Classification Search ..... 34/551, 34/72, 629, 632, 636, 209, 210, 215, 216, 34/241, 86, 514, 576, 131, 132, 212, 219; 431/12; 432/59, 72
See application file for complete search history.

(56) References Cited

U.S. PATENT DOCUMENTS 3,216,127 A * 11/1965 Ruff ..... 34/569
3,849,904 A * 11/1974 Villalobos ..... 34/636
4,132,007 A * 1/1979 Voorheis ..... 34/86
4,189,846 A * 2/1980 Fiedler et al. ..... 34/576
5,038,498 A * 8/1991 Woolsey ..... 34/219
5,865,611 A * 2/1999 Maiello ..... 431/12

FOREIGN PATENT DOCUMENTS

DE 2524151 A * 12/1976
JP 2003-98685 A 4/2003

* cited by examiner

*Primary Examiner*—Jiping Lu
(74) *Attorney, Agent, or Firm*—Birch, Stewart, Kolasch & Birch, LLP

(57) ABSTRACT

A drying apparatus is provided with a gas burner indirect heat exchanger wherein a turn down ratio thereof maybe controlled. In a housing of the gas burner indirect heat exchanger, a gas burner and a heat exchanger are contained. Combustible gas in the gas burner is supplied to the heat exchanger. The air having entered the housing is heated as passing around the gas burner and, furthermore, passing through the heat exchanger. The housing is connected to the dryer booth by a blowing duct. A blower provided in a middle of the blowing duct supplies the hot air heated in the gas burner indirect heat exchanger to the dryer booth. In the dryer booth, an aluminum web coated with coating liquid is transferred. The hot air is blown to the coated surface of the aluminum web so as to dry the coated liquid.

14 Claims, 3 Drawing Sheets

DRYING APPARATUS

This Non-provisional application claims priority under 35 U.S.C. § 119(a) on Patent Application No(s). 2003-312433 filed in Japan on Sep. 4, 2003, the entire contents of which are hereby incorporated by reference.

BACKGROUND OF THE INVENTION

1. Field of the Invention

The present invention relates to a drying apparatus, particularly to the drying apparatus suitable for a drying process in a manufacturing line of a presensitized plate (hereinafter PS plate).

2. Background Arts

In a PS plate manufacturing line, an aluminum web is coated with a coating liquid and dried in a dryer booth. Then, a coated aluminum web is cut into a predetermined size to obtain a PS plate.

A drying apparatus for drying a coated surface of the aluminum web by blowing hot air thereto is well known (for example, cited in Japanese Patent Laid-Open Publication Number 2003-98685). The coating liquid used for the PS plate of such as conventional type or digital-corresponding type (called CTP) are different depending on the types of the PS plate, and a web temperature for drying the coated surface is varied widely in accordance with properties of the coating liquids. Accordingly, it requires a wide range of temperature (for example, about 50-200° C.) for drying air corresponding to all types of the PS plate.

In the drying apparatus for the PS plate cited in Japanese Patent Laid-Open Publication Number 2003-98685 above set forth, steam is supplied to a heat exchanger from a boiler for generating hot air. High pressure steam is required to gain hot air; for example, in order to generate hot air of 200° C., 2 Mpa (20 kg/cm$^2$) of high pressure steam is required. Meanwhile, in order to generate air of 50° C., it is required to reduce the steam or steam pressure. The steam is reduced by providing a plural of steam controlling valves in parallel with each other, while steam pressure is reduced by piping via a decompression control valve. However, it is hard to adjust the temperature of drying air for drying the PS plates, which requires that the temperature of drying air is controlled to be a predetermined temperature with high accuracy (±1° C. of error).

Equipments such as a high pressure boiler and a high pressure piping are necessary to supply the heat exchanger with steam such that the heat exchanger send hot air in a wide range of 50-200° C. into the dryer booth in the PS plate manufacturing line, and accuracy of the temperature of hot air needs to be maintained corresponding to the change of the amount of hot air. However, it results in rising of costs for equipments and maintenance. An oil heater and an electronic heater may be alternatively used to heat air for drying the aluminum web, or a heat roll and a coil may also be used to heat the aluminum web directly by induction heating. Nevertheless, the problem of raising costs for equipments and maintenance is still remained.

SUMMARY OF THE INVENTION

A main object of the present invention is to provide a drying apparatus having an ability to control the temperature of hot air with high accuracy. Other object of the present invention is to provide the drying apparatus that may reduce costs for equipments and maintenance. Furthermore, the other object of the present invention is to provide the drying apparatus fulfilling the conditions for drying coating liquid on a PS plate.

In order to achieve the above objects, a drying apparatus according to the present invention is provided with a gas burner indirect heat exchanger (hereinafter GHE), wherein a gas flow rate may be adjusted by controlling a turn down ratio of the burner furnace. The air heated in the GHE is supplied to a dryer booth by a blowing fan provided in a blowing duct. The hot air is blown at the surface of a web, coated with a coating liquid, to dry the coating liquid while the web is passing through the dryer booth.

The GHE contains a gas burner furnace and a heat exchanger in the housing thereof. Combustible gas in the gas burner furnace is supplied to the heat exchanger, then a part of the combustible gas is returned to the gas burner furnace. The air having entered the housing is heated while passing around the gas burner furnace and heated furthermore as passing through the heat exchanger.

In a preferred embodiment of the present invention, the drying apparatus is used in a PS plate manufacturing line for forming a photosensitive layer on an aluminum web. In the GHE, the turn down ratio of the burner furnace is controlled within a range of 1 (fully opened)-1/20. The temperature of the hot air is controlled to be a predetermined temperature within a range of 50-200° C. with high accuracy (±1° C. of error).

The blowing duct has a length of more than 10 m, and is preferably provided with a stirrer to achieve uniformity of temperature distribution of the hot air in the blowing duct.

According to the present invention, hot air having a wide range of temperature (50-200° C., for example) may be generated with high accuracy of controlling the temperature. Additionally, using the GHE may reduce the costs for equipments and maintenance, as neither a high pressure boiler nor a high pressure piping, which are conventionally used, are necessary. Therefore, the costs for manufacturing the PS plate may be reduced by applying the drying apparatus of the present invention into the PS plate manufacturing line.

BRIEF DESCRIPTION OF THE DRAWINGS

One with ordinary skill in the art would easily understand the above-described objects and advantages of the present invention when the following detailed description is read with reference to the drawings attached hereto.

PREFERRED EMBODIMENTS OF THE INVENTION

Figure 1:
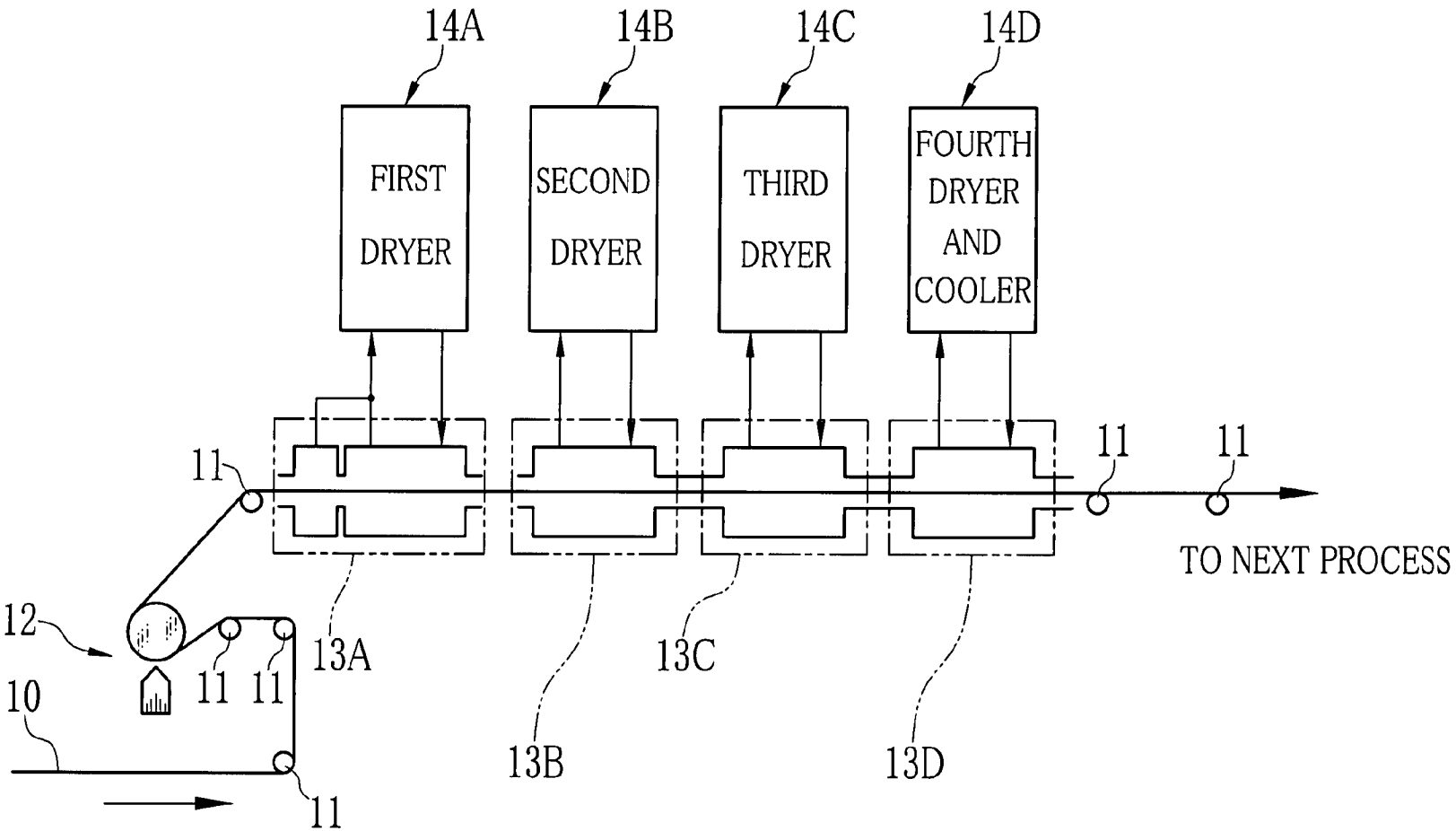
FIG. 1 is a schematic view of a PS plate manufacturing line.

In FIG. 1 showing a manufacturing line of a presensitized plate (PS plate) wherein a drying apparatus of the present invention is applied, an aluminum web 10, whose surface is treated by a surface treating device (not shown), is transported to a coating device 12 by a plural of rollers 11. The surface of the aluminum web 10 is coated with a coating liquid by the coating device 12 to form a coated layer. Then, the aluminum web 10 is transported sequentially to a dryer booth by the rollers 11 with following a conveying path for the aluminum web 10. A plural of dryer booths are provided in the drying apparatus: a first dryer booth 13A, a second dryer booth 13B, a third dryer booth 13C, and a fourth dryer and cooler booth 13D.

Each of the first dryer booth 13A, the second dryer booth 13B, the third dryer booth 13C, and the fourth dryer and cooler booth 13D is provided with a first dryer 14A, a second dryer 14B, a third dryer 14C, and a fourth dryer and cooler 14D respectively. Each of the first dryer 14A, the second dryer 14B, the third dryer 14C, and the fourth dryer and cooler 14D sends hot air respectively to the first dryer booth 13A, the second dryer booth 13B, the third dryer booth 13C, and the fourth dryer and cooler booth 13D so as to dry the coated layer formed on the aluminum web 10. Next, the aluminum web 10 is transported by the rollers 11 to the next process, wherein another coated layer is formed on the aluminum web 10, then dried and cooled. After that, the aluminum web 10 is cut by a slitter (not shown) into PS plates having a predetermined size. Alternatively, a cooler may be provided in addition to the fourth dryer and cooler 14D to cool the aluminum web 10.

The PS plate is manufactured by forming a coating layer on a rectangular and thin aluminum support. The coating layer is a photosensitive layer for a photosensitive PS plate and a heat-sensitive layer for a heat-sensitive PS plate. An overcoat layer and a mat layer may also be formed, if necessary. Plate-making processes such as exposing, developing and gum coating are executed for the coated layer, and then the PS plate is set in a printer to be coated with ink and prints characters and images on a paper. Though the composition of the PS plate is not limited specifically in the present embodiment, the PS plate for a laser printing of a heat mode system or a photon mode system, for example, are capable of direct plate making from digital data.

Figure 2:
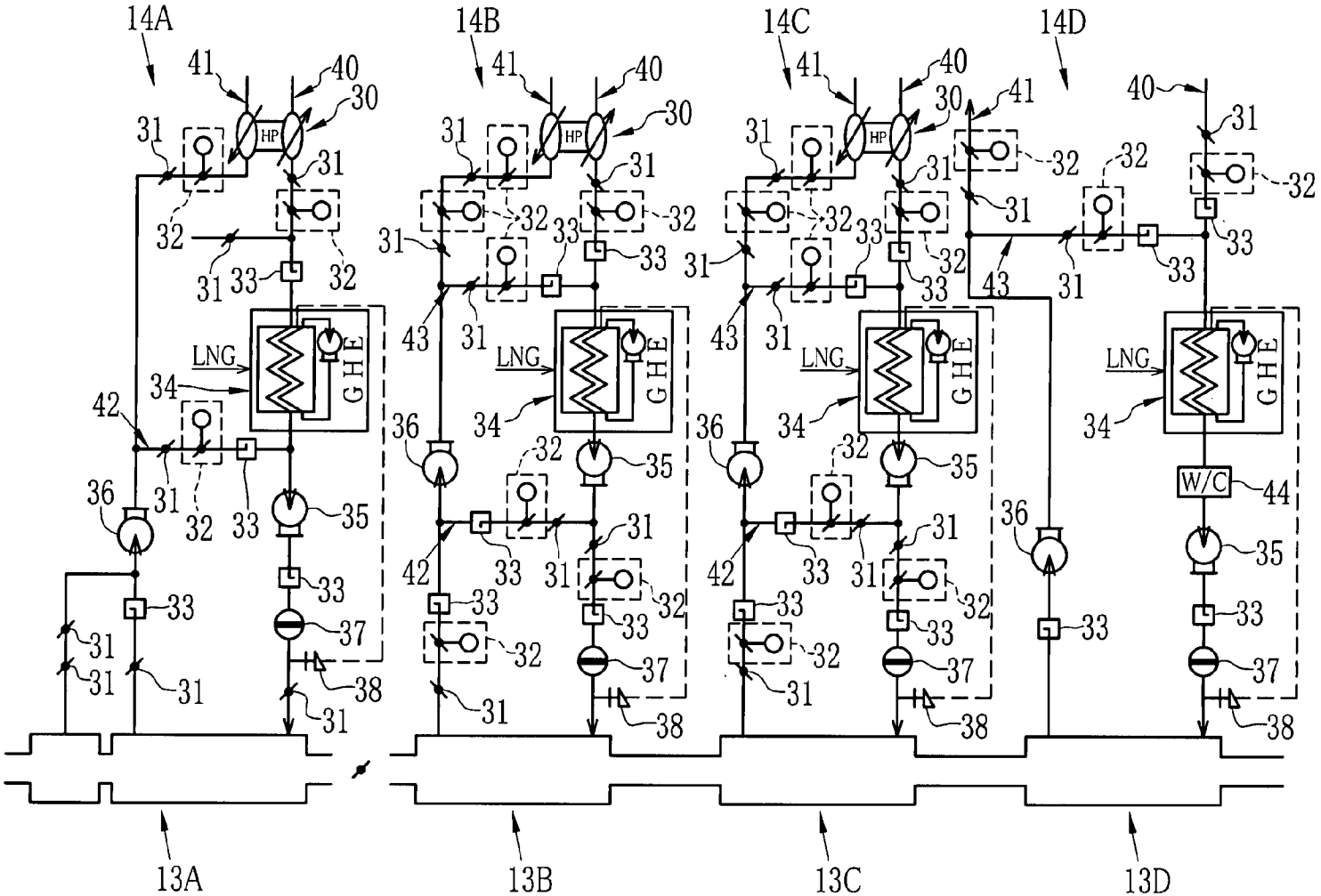
FIG. 2 is a schematic view illustrating a composition of a drying apparatus of the present invention.

FIG. 2 shows the first dryer 14A, the second dryer 14B, the third dryer 14C, and the fourth dryer and cooler 14D. Since the first dryer 14A, the second dryer 14B, and the third dryer 14C have approximately the same composition, the second dryer 14B is used as an example to explain. The second dryer 14B is composed of a heat pipe 30, which functions as a heat exchanger, a plural of manual dampers 31, a plural of automatic dampers 32, a Pitot tube 33 for measuring flowing velocity of fluid, a Gas burning Heat Exchanger (GHE) 34, a blowing fan 35 as a blowing means, an exhaust fan 36, a filter 37 to trap dust, a temperature sensor 38, a blowing duct 40, an exhaust duct 41, a first circulating duct 42, and a second circulating duct 43.

The heat pipe 30 is provided adjacent to an intake of the blowing duct 40 and an outlet of the exhaust duct 41. The heat pipe 30 heats the air enters the blowing duct 40 by transmitting the heat from the air discharged from the exhaust duct 41. Since the heat pipe 30 reuses the heat of discharged air to heat the air enters the blowing duct 40, it may improve energy efficiency.

The blowing duct 40 is provided with the manual damper 31 and the automatic damper 32 on the downstream side of the heat pipe 30. The manual damper 31 is operated by an operator to adjust flow amount in the blowing duct 40. The Pitot tube 33 is provided on the downstream side of the automatic damper 32 to measure flowing velocity of the air in the blowing duct 40. The automatic damper 32 is electrically connected to the Pitot tube 33 and controlled based on the flow velocity measured by the Pitot tube 33.

The GHE 34 is provided on the downstream side of the Pitot tube 33, and the blowing fan 35 is provided on the downstream side of the GHE 34. As stated later, the GHE 34 heats air by a gas burner furnace and send hot air. The hot air is guided to further downstream side by the blowing fan 35.

The manual damper 31, the automatic damper 32, and the Pitot tube 33 are provided on the downstream side of the blowing fan 35 and operate in the same way as them on the upstream side of the GHE 34 to control the flow velocity of the air heated in the GHE 34. The filter 37 is provided on the downstream side of them, and the hot air, from which dust is removed by the filter 37, is sent into the second dryer booth 13B via the outlet of the blowing duct 40.

The temperature sensor 38 is provided between the filter 37 and the second dryer booth 13B and electrically connected to the GHE 34 to send the GHE 34 the measured value of the temperature gained by the temperature sensor 38. Based on the measured value of the temperature, the GHE 34 controls the gas burner furnace to adjust the temperature of the heated air.

The heated air sent into the second dryer booth 13B is discharged via the exhaust duct 41. The manual damper 31, the automatic damper 32, and the Pitot tube 33 are provided to the exhaust duct 41 and operate in the same way as them disposed at the blowing duct 40 to control the flowing velocity of the air in the exhaust duct 41. The exhaust fan 36 is provided on the downstream side of them to suck the air from the second dryer booth 13B into the exhaust duct 41.

The first circulating duct 42 connecting the blowing duct 40 and the exhaust duct 41 is provided between the downstream side of the blowing fan 35 and the upstream side of the exhaust fan 36. The manual damper 31, the automatic damper 32, and the Pitot tube 33 are provided on the first circulating duct 42 and operate in the same way as them provided on the blowing duct 40 to control the flow velocity of the air in the first circulating duct 42. The air flowing from the exhaust duct 41 to the first circulating duct 42 enters the blowing duct 40 and is sent to the second dryer booth 13B again via the manual damper 31, the automatic damper 32, the Pitot tube 33, and the filter 37.

The second circulating duct 43 connecting the blowing duct 40 and the exhaust duct 43 is provided between the downstream side of the exhaust fan 36 and the upstream side of the GHE 34. The manual damper 31, the automatic damper 32, and the Pitot tube 33 are provided on the second circulating duct 43 and operate in the same way as them provided on the first circulating duct 42 to control the flow velocity of the air in the second circulating duct 43. The air flowing from the exhaust duct 41 to the second circulating duct 43 enters the blowing duct 40 again and is mixed with the air flowing from the intake of the blowing duct 40.

On the further downstream side of the exhaust fan 36, two pairs of the manual dampers 31 and the automatic dampers 32 are provided to control the flow velocity of the air in the exhaust duct 41. When the air passing through the automatic damper 32 is discharged outside the second dryer 14B via the heat pipe 30, the heat pipe 30 transmits heat of the discharged air to the air flowing into the blowing duct 40. The variable amount of drying air is maintained within a range of 40-360 $m^3$/min by controlling the rotary velocity of both of the blowing fan 35 and the exhaust fan 36 and the opening degrees of both of the manual damper 31 and the automatic damper 32.

Figure 3:
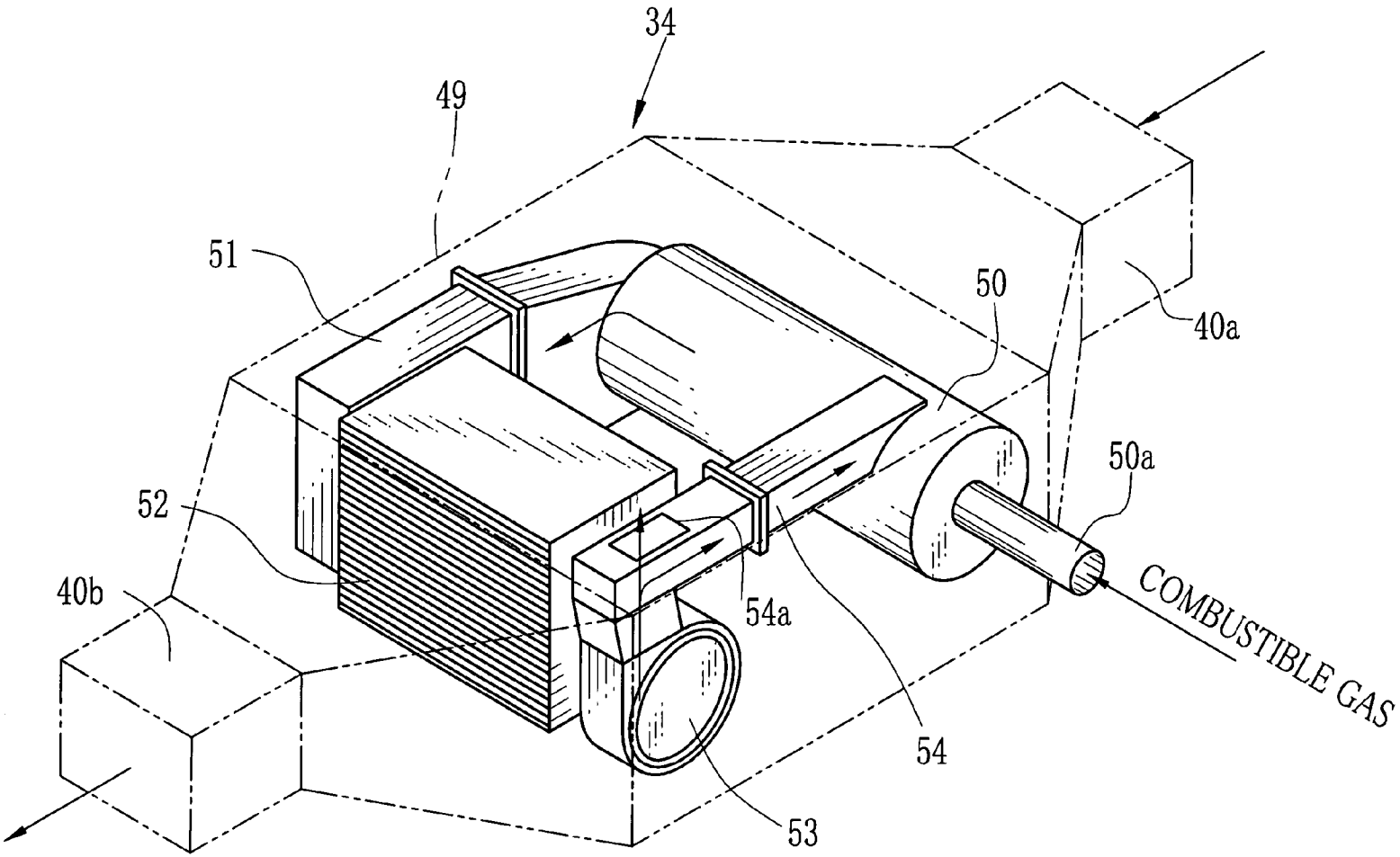
FIG. 3 is a schematically perspective view illustrating a composition of a GHE.

As shown in FIG. 3, the GHE 34 compactly contains a gas burner furnace and a heat exchanger in a housing thereof to enhance heat exchange efficiency. The GHE 34 is composed of a housing 49, a gas burner furnace 50, a blowing duct 51, a heat exchanger 52, a circulating fan 53, and a duct 54. Liquefied natural gas (LNG) and compressed air are supplied to the gas burner furnace 50 that burns LNG as fuel.

An intake duct 40*a* and an outlet duct 40*b* are respectively connected to the rear side of the housing 49 and to the front side of the housing 49. The intake duct 40*a* and the outlet duct 40*b* compose a part of the blowing duct 40 shown in FIG. 2. The gas burner furnace 50, the blowing duct 51, the heat exchanger 52, and the circulating fan 53 are contained in the housing 49.

The combustible gas, wherein LNG and compressed air are mixed together, is supplied to the gas burner furnace 50 via a pipe 50*a* to be burnt in the gas burner furnace 50. Then, the combustible gas is transferred to the heat exchanger 52 via the blowing duct 51. After passing the heat exchanger 52, the combustible gas is returned by the circulating fan 53 to the gas burner furnace 50 via the duct 54 to be burnt again. An exhaust hole 54*a* is formed on the duct 54, such that a part of the combustible gas is discharged outside the housing 49 via the exhaust hole 54*a* and a chimney (not shown).

In the housing 49, air enters the intake duct 40*a* is heated while passing around the gas burner furnace 50 and through the heat exchanger 52. The heated air is sucked by the blowing fan 35 through the outlet duct 40*b*.

A control valve may control calorific value of the gas burner furnace 50 by changing the flow amount of the combustible gas (mixed gas of LNG and air). A turn down ratio of the control valve is adjusted within a range of 1 (fully opened)-1/20. Alternatively, the control valve turns down either the compressed air or LNG, and the other one is turned down in proportion. Note that LNG and the compressed air are mixed together before being supplied to the gas burner furnace 50 or, alternatively, LNG and the compressed air are supplied separately to the gas burner furnace 50 to be mixed together in the gas burner furnace 50.

In the burner furnace 50, as stated above, the turn down ratio is selected within a range of 1 (fully opened)-1/20, and the calorific value per unit time is controlled within a range of 6,300-15,750 kcal/h. Thereby, the temperature of the hot air may be controlled to be a predetermined temperature within a range of 50-200° C. with high accuracy (±1° C. of error), with 40-360CMM of the variable amount of drying air.

In order to ensure safety of the gas burner furnace 50, combustion safety devices such as a safety control relay, a prepurge, a pilot burner, a main burner, an after-purge, an interlock, an emergency cut off valve, an ultra vision, a pressure switch, an air pressure switch, a rotary switch, an interlock with the burner, and a vent valve are controlled in the GHE 34.

A surface temperature of the heat exchanger 52 in the GHE 34 is controlled to be under 400° C., wherein combustible gas of any concentration does not catch fire. In addition, the heat exchanger 52 is constituted to have negative pressure inside thereof such that the combustible gas does not leak into the housing 49 in case the heat exchanger 52 cracks. Furthermore, an inspection window (not shown) is provided such that cracks may be inspected visually.

Next, operations of the second dryer 14B having composition stated above is explained. The air having entered the intake of the blowing duct 40 is transferred through the blowing duct 40 by the blowing fan 35, while the flowing velocity of the air is controlled by the manual dampers 31 and the automatic dampers 32. The air in the blowing duct 40 is heated by the GHE 34 and transferred. The temperature of the hot air is controlled to be a predetermined temperature within a range of 50-200° C. with high accuracy (±1° C. of error). In addition, the blowing duct 40 between the GHE 34 and the second dryer booth 13B has a length of more than 10 m so as to achieve uniformity of temperature distribution of the hot air, blown by the blowing fan 35, in the blowing duct 40. Alternatively, a stirrer may be provided on the downstream side of the blowing fan 35 such that the temperature distribution of the hot air in the blowing duct 40 is more uniformed.

Additionally, energy efficiency is improved, since the hot air sent from the blowing duct 40 to the second dryer booth 13B is guided to the blowing duct 40 again by the first circulating duct 42 and the second circulating duct 43, the hot air in the exhaust duct 41 is reused.

Note that, in order to ensure safety, the air circulated by the first circulating duct 42 and the second circulating duct 43 for circulating dry air is limited to have less than 25% of organic solvent gas concentration, which is a lower limit of gas explosion. In the first dryer booth 13A for example, the organic solvent gas concentration is higher than ones in other dryer booths, as the aluminum web shortly after coated with coating liquid is transported into the first dryer booth 13A. Therefore, the GHE 34 heats not circulated air but instead fresh air taken from outside of the drying apparatus and transports the heated air into the first dryer booth 13A.

Since the first dryer 14A and the third dryer 14C have approximately the same compositions as the second dryer 14B, whose composition and the operation are explained above, the same devices in the first dryer 14A and the third dryer 14C as the devices in the second dryer 14B are given corresponding numerals, and explanations for them are omitted. As for the operations of the first dryer 14A and the third dryer 14C, both of them operate in the same way as the second dryer 14B.

Next, a composition of the fourth dryer and cooler 14D is explained. The fourth dryer and cooler 14D has the composition of the second dryer 14B from which the first circulating duct 42, the heat pipe 30, and parts of a plural of the manual dampers 31 and the automatic dampers 32 are omitted. The same devices in the fourth dryer and cooler 14D as the devices in the first dryer 14A, the second dryer 14B, and the third dryer 14C are given corresponding numerals, and explanations for them are omitted. In the fourth dryer and cooler 14D, a heat exchanger 44 is provided on the downstream side of the GHE 34.

In order to dry the aluminum web 10 by blowing cooled air into the fourth dryer and cooler booth 13D, the GHE 34 is stopped operating and cooling water is circulated in a cooling coil in the heat exchanger 44. Thereby, the air having entered from outside of the fourth dryer and cooler 14D is cooled by the heat exchanger 44 and transferred to the fourth dryer and cooler booth 13D.

In order to dry the aluminum web 10 by blowing hot air into the fourth dryer and cooler booth 13D, the GHE 34 is operated and the heat exchanger 44 is stopped operating. Thereby, the air having entered from outside of the fourth dryer and cooler 14D is heated by the GHE 34 and transferred to the fourth dryer and cooler booth 13D. The fourth dryer and cooler 14D may transfer alternatively hot air or cooled air to the fourth dryer and cooler booth 13D according to requirements.

Though the drying apparatus of the present invention is used in the PS plate manufacturing line in the above embodiment, the present invention is not limited in the above embodiment but may also be applied in a drying processes of continuous flexible webs such as baryta paper for printing paper and base materials for a photo film, a recording tape, a video tape, or a floppy (R) disk, for example.

Although the present invention has been described with respect to the preferred embodiments, the present invention is not to be limited to the above embodiments but, on the contrary, various modifications will be possible to those skilled in the art without departing from the scope of claims appended hereto.

What is claimed is:

1. A drying apparatus for supplying a dryer booth with hot air for drying comprising:

a gas burner indirect heat exchanger, wherein a turn down ratio thereof may be controlled;

a blower for sending said hot air, heated by said gas burner indirect heat exchanger, to said dryer booth, the blower having an input side and an output side;

a blowing duct, disposed between said gas burner indirect heat exchanger and said dryer booth, to guide said hot air sent by said blower to said dryer booth;

an exhaust duct for exhausting hot air from the dryer booth;

an exhaust blower disposed in the exhaust duct;

a first circulating duct, disposed between the exhaust duct and the blowing duct to guide exhausted hot air from the dryer booth back again to the dryer booth, and a second circulating duct that connects to the blowing duct on an upstream side of the gas burner indirect heat exchanger and to the exhaust duct on a downstream side of the exhaust blower;

wherein:

the blower is disposed in the blowing duct between said gas burner indirect heat exchanger and said dryer booth and directly receives the hot air, heated by said gas burner indirect heat exchanger, on the input side, and the first circulating duct connects to the blowing duct on a downstream side of the blower.

2. The drying apparatus claimed in claim 1, wherein said gas burner indirect heat exchanger comprises:

a gas burner furnace wherein combustible gas is burnt; and a heat exchanger to heat air by combustible gas of said gas burner furnace.

3. The drying apparatus claimed in claim 2, wherein said gas burner indirect heat exchanger further comprises:

a housing for containing said gas burner furnace and said heat exchanger;

an intake duct provided at one side of said housing;

an outlet duct provided at other side said housing and comprising a part of said blowing duct;

wherein said air having entered said housing via said intake duct is heated while passing around said gas burner furnace and passing through said heat exchanger, and then said air is discharged via said outlet duct and flows toward said blower.

4. The drying apparatus claimed in claim 3, wherein said combustible gas passes through said heat exchanger, and then a part of said combustible gas is returned to said gas burner furnace.

5. The drying apparatus claimed in claim 4, wherein a web coated with coating liquid is transferred in said dryer booth, and said hot air is blown to a coated surface of said web to dry said coating liquid.

6. The drying apparatus claimed in claim 5, wherein said coated web is a presensitized material, and wherein said web is made of aluminum.

7. The drying apparatus claimed in claim 6, wherein said blowing duct has a length of more than 10 m.

8. The drying apparatus claimed in claim 7, further comprising a stirrer provided in said blowing duct, for achieving uniformity of temperature distribution of the hot air, sent from said gas burner indirect heat exchanger, in said blowing duct.

9. The drying apparatus claimed in claim 4, wherein said turn down ratio is adjusted within a range of 1(fully opened)-1/20.

10. The drying apparatus claimed in claim 9, wherein said turn down ratio controls a calorific value per unit time to be within a range of 6,300-15,750 kcal/h, and thereby the temperature of said hot air is controlled to be a predetermined temperature within a range of 50-200° C. with high accuracy (±1° C. of error), with a variable amount of drying air in 40-360 $m^3$/min.

11. The drying apparatus claimed in claim 4, further comprising a temperature sensor provided close to said dryer booth, wherein said turn down ratio is controlled based on the temperature of said hot air measured by said temperature sensor.

12. The drying apparatus claimed in claim 11, wherein said gas burner indirect heat exchanger is controlled to be under 400° C. for combustible gas therein not to catch fire.

13. The drying apparatus claimed in claim 12, further comprising a mechanism to keep the inside of said gas burner indirect heat exchanger at negative pressure such that combustible gas would not leak into said housing even if said gas burner indirect heat exchanger cracks.

14. The drying apparatus claimed in claim 13, further comprising a duct returning said part of said combustible gas to said gas burner furnace, wherein the mechanism to keep the inside of said gas burner indirect heat exchanger at negative pressure includes a circulating fan and an exhaust hole in the duct returning said combustible gas to said gas burner furnace.

* * * * *